United States Patent [19]

Novak

[11] 4,428,541

[45] Jan. 31, 1984

[54] BOBBIN AND A BOBBIN SUPPORT STRUCTURE FOR A ROVING FRAME

[75] Inventor: Peter Novak, Tägerwilen, Switzerland

[73] Assignee: Rieter Machine Works, Limited, Winterthur, Switzerland

[21] Appl. No.: 405,563

[22] Filed: Aug. 5, 1982

Related U.S. Application Data

[63] Continuation of Ser. No. 191,125, Sep. 26, 1980, abandoned.

[51] Int. Cl.[3] ..... B65H 54/54

[52] U.S. Cl. ..... 242/46.2; 242/18 PW; 242/46.21; 242/125.1; 57/299; 57/303

[58] Field of Search ..... 242/46.2, 46.21, 46.3, 242/46.4, 46.5, 46.6, 46.7, 46.8, 125, 125.1, 125.2, 125.3, 18 PW; 57/129, 130, 131, 267, 270, 275, 299, 303

[56] References Cited

U.S. PATENT DOCUMENTS

| | | | |
|---|---|---|---|
| 432,856 | 7/1890 | Boelsterli | 242/46.7 |
| 686,446 | 11/1901 | Draper | 242/46.7 |
| 778,246 | 12/1904 | Hughes | 242/46.7 |
| 924,891 | 6/1909 | Curfew et al. | 242/46.7 |
| 1,007,239 | 10/1911 | Roney et al. | 242/46.7 |
| 2,463,591 | 3/1949 | Bauer | 242/46.21 |
| 2,625,336 | 1/1953 | Brouillard | 242/46.6 |
| 2,654,542 | 10/1953 | Parsons | 242/46.6 |
| 2,827,244 | 3/1958 | Perry | 242/125.1 X |
| 3,018,973 | 1/1962 | Bradley | 242/125.1 X |
| 3,051,411 | 8/1962 | Atwood et al. | 242/125.1 |
| 3,246,856 | 4/1966 | Winslow | 242/46.21 |
| 3,321,901 | 5/1967 | Adams et al. | 57/131 |
| 3,544,026 | 12/1970 | Bowie et al. | 242/46.6 |
| 3,935,699 | 2/1976 | Iida et al. | 57/270 X |
| 4,154,409 | 5/1979 | Reisser et al. | 242/125.1 X |
| 4,168,809 | 9/1979 | Fratturo | 242/46.21 |

FOREIGN PATENT DOCUMENTS

| | | |
|---|---|---|
| 1107004 | 7/1955 | France . |

*Primary Examiner*—Stanley N. Gilreath
*Attorney, Agent, or Firm*—Kenyon & Kenyon

[57] ABSTRACT

The bobbin for receiving a roving has an internal shoulder enabling it to seat on a surface provided at the upper end 5 of a spindle. The bobbin hangs from this shoulder and the bottom of the bobbin is received in a resilient clamping means provided on the spindle for clamping a roving end against the bobbin.

20 Claims, 2 Drawing Figures

BOBBIN AND A BOBBIN SUPPORT STRUCTURE FOR A ROVING FRAME

Figure 1:
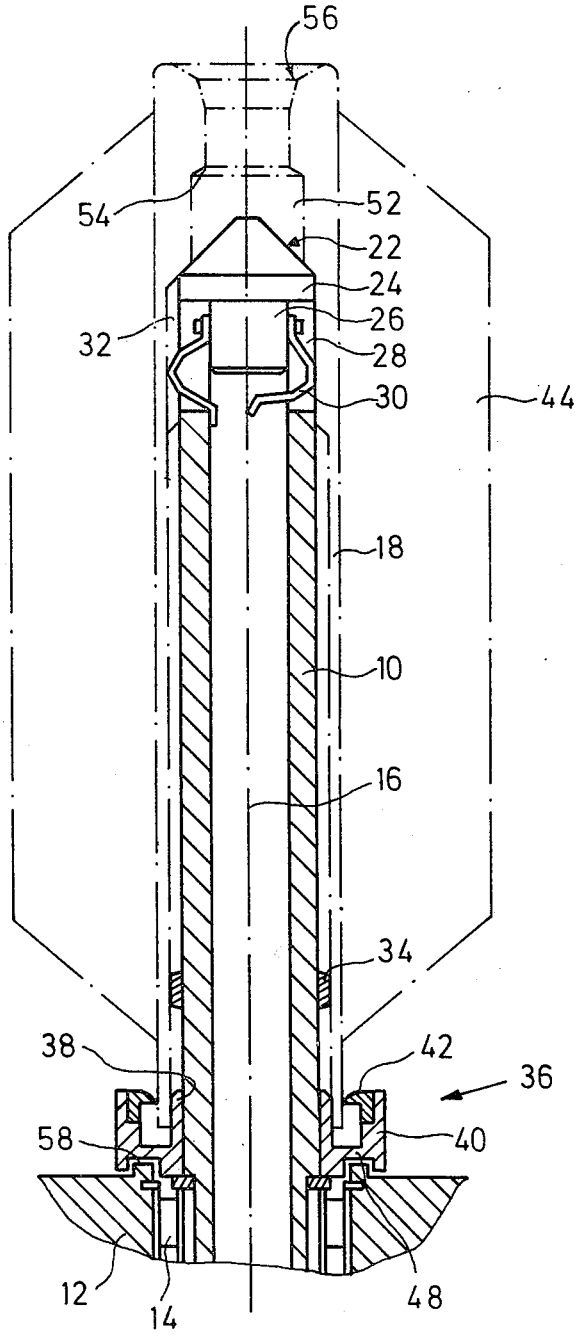

This application is a continuation of Ser. No. 191,125, filed Sept. 26, 1980, now abandoned.

This invention relates to a bobbin and a bobbin support structure for a roving frame.

As is known, roving frames have been provided with a bobbin support structure in the form of a spindle which is mounted in an upright manner in a spindle bolster and provided at or near the bolster with a pedestal fitted with a drive dog or detent mechanism to engage and drive a bobbin mounted over the spindle and supported body pedestal. Such a construction is described, for example, in Swiss Pat. No. 236,212 and Japanese Published Patent application No. 53/41414. In such a construction, the base of the bobbin is formed not only to rest on the pedestal but also to have externally open drive openings such as teeth. This, however, makes it difficult to use the base region of the bobbin for any other purpose.

Accordingly, it is an object of the invention to provide a roving bobbin and a roving frame bobbin support which permits the incorporation of additional functions for the bobbin.

It is another object of the invention to provide a bobbin of relatively simple construction which can be engaged with a drive spindle and which can clamp a roving tail in place.

It is another object of the invention to provide a bobbin support structure of relatively simple construction for mounting a bobbin in place in a roving frame.

Briefly, the invention provides a bobbin for a roving frame which has a tubular body, an internal shoulder within the body for seating on a support surface and means at one end of the body for engaging a roving tail. This latter means may be in the form of an array of teeth which are uniformly distributed circumferentially about the tubular body.

In addition, the tubular body has a head portion at an opposite end and adjacent the shoulder as well as means in the head portion for engaging with a doffer element. The bobbin also has means immediately adjacent the shoulder for releaseably connecting the tubular body to a rotatable support structure.

The invention also provides a bobbin support structure which comprises a bobbin engaging means for engaging an internal structure of the tubular bobbin and means for clamping a roving tail against an outwardly facing surface of the received bobbin. The means for clamping the roving tail is in the form of a resilient socket which is secured to the bobbin engaging means. The socket may also include a trough for receiving fibers which are separated from a roving tail.

The bobbin support structure may be in the form of a spindle which is vertically disposed with a frusto-conical end surface at the upper end. In this case, the internal conical shoulder of the bobbin is seated on the end surface of the spindle and the head portion of the bobbin is located above the shoulder with a depending portion located below the shoulder. The means within the head portion for engaging with a doffer element, for example, of an automatic doffing system on a roving frame, may be in the form of an internal abutment, such as another shoulder, which is engageable by fingers on the doffer element which are capable of extending into the head portion. The head portion may also be formed with a bore having a mouth of frusto-conical shape in order to facilitate insertion of the doffer element.

The dependent portion of the bobbin carries the teeth for clamping a roving tail at the start of winding thereon.

In principle, the internal shoulder of the bobbin can be provided at almost any location along the length of the bobbin. However, the shoulder is preferably adjacent the head portion of the bobbin since this enables use of the upper end of the support structure to provide a bobbin engaging means. The internal shoulder is not necessarily at right angles to the bobbin axis but is preferably frusto-conical, converging towards the head portion. The bobbin engaging means on the support structure is correspondingly formed. The internal bore of the depending portion of the bobbin may be formed to cooperate with the support structure below the shoulder in order to align the bobbin vertically in use.

In principle, the means for releaseably connecting the tubular body to a rotatable support structure may be provided at any position along the length of the bobbin. However, this means is preferably provided adjacent to the internal shoulder. This means may also include one or more generally circumferentially facing surfaces, for example, on an inwardly directed grid for cooperating with a drive transmitting projection on the support structure. For example, the drive transmitting projection may be in the form of an outwardly biased spring which engages with the rib in an interfitting relation.

The bobbin may be constructed in a plurality of parts which are secured together. Further, the bobbin may be made of a suitable synthetic plastics material.

The bobbin and bobbin support structure are formed in relation to each other so that the end of the bobbin below the internal shoulder does not, in use, engage any surface on the support structure.

Figure 2:
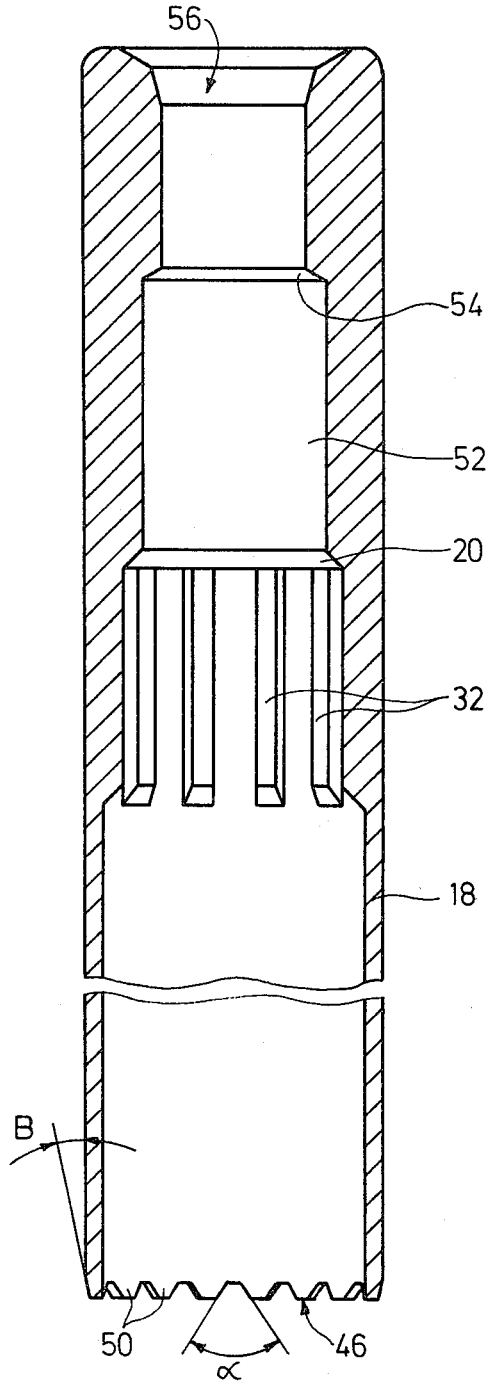

These and other objects and advantages of the invention will becomes more apparent from the following detailed description taken in conjunction with the drawings wherein:

FIG. 1 illustrates a sectional side-elevational view of a bobbin support structure with a bobbin and roving package thereon in accordance with the invention; and FIG. 2 illustrates a cross-sectional view of a bobbin constructed in accordance with the invention.

Referring to FIG. 1, the bobbin support structure is in the form of a hollow metal spindle 10 which is rotatably mounted in a spindle bolster 12 via suitable bearings having rollers 14. The spindle 10 is provided in known manner below the bolster 12 with a drive whorl for rotation of the spindle 10. As the drive whorl forms no part of the invention, no further description is believed to be required.

The bolster 12 is mounted in known fashion in a spindle carrying beam (not shown) of a spinning preparatory machine for preparing textile fiber for a spinning frame, for example, a roving frame. However, the present invention is not limited to use with such frames. Further, such a roving frame may have an automatic doffer.

The spindle 10 is mounted vertically about an axis 16 and receives a hollow bobbin 18. The bobbin 18, in turn, receives a package of roving 44 in known manner. As shown, the spindle 10 has a frusto-conical end surface 22 at the upper end. This surface 22 is formed by an end cap 24 having a shank 26 threaded into an opened upper end of the spindle 10. The material of this end cap 24 may be different from that of the remainder of the spindle 10 and may be suitably hardened, if required, to form an accurate abutment surface or bobbin engaging means for the bobbin 18. In addition, the spindle 10 has a means for releaseably connecting the bobbin 18 to the spindle 10 for rotation therewith. This means is in the form of a pair of outwardly biased leaf springs 30 which are secured to the shank 26 of the end cap 24. These springs 30 project through two diametrically opposite grooves 28 in the spindle 10 so that portions of the springs 30 extend radially outwardly beyond the external surface of the spindle 10.

The spindle 10 also carries a means for clamping a roving tail against an outwardly facing surface of the bobbin 18 at the lower end of the bobbin 18. This means is in the form of an annular member 36 which is separately formed and is secured to the spindle 10 just above the bolster 12. The annular member 36 forms a resilient socket or trough, an open side of which faces upwardly to receive the lower end or foot of the bobbin 18. The annular member 36 has an inner wall 38 adjacent the spindle 10 which acts as a centering ring for the bobbin 18. In addition, the annular member 36 has an outer wall 40 which carries an inwardly projecting annular lip 42 in the form of a resilient ring which is secured to the wall 40 in any convenient manner. This resilient ring 42 encircles and engages the bobbin 18 for holding a roving tail therebetween. The construction and dimensions of the resilient ring 42 is such that the ring is slightly expanded by the bobbin 18 when the bobbin 18 passes into the trough formed by the annular member 36.

Referring to FIGS. 1 and 2, the bobbin 18 is in the form of a cylindrical tubular body with an internal shoulder 20 for seating on the support surface 22 of the spindle 10. As indicated, the shoulder 20 is of frusto-conical shape and sized so that the bobbin 18 rests only on the surface 22 of the spindle 10. The bobbin has a head portion located above and adjacent the shoulder 20, as viewed. As indicated in FIG. 1, the head portion projects above the spindle 10 and comprises a chamber 52 between the shoulder 20 and a second internal shoulder 54 which also faces the opposite end of the bobbin 18. The head portion also has a bore at the end which forms a mouth 56 of inwardly convergent frusto-conical shape. This bore permits a doffer element with spring or gravity loaded radially outwardly projecting fingers to push into the bobbin head so that the fingers can engage under the shoulder 54 and lift the bobbin 18 off the spindle 10 (see FIG. 1). A so-called Casablanca connector is suitable for this purpose. The head thus facilitates automatic doffing of the bobbin 18 with a completed package 44 thereon.

The bobbin 18 also has a depending portion below the shoulder 20 as viewed in FIG. 2. This depending portion includes means immediately adjacent the shoulder 20 for releasably connecting the bobbin 18 to the spindle 10. As shown, this means is in the form of a plurality of inwardly directed ribs 32 which are spaced apart to receive the leaf springs 30 therebetween in interfitting relation. As shown in FIG. 1, when the bobbin 18 is mounted on the spindle 10, the outwardly extending portions of the springs 30 pass into the spaces or grooves formed between the ribs 32 and form a positive driving connection with the bobbin 18. The springs 30 thus form a drive means on the spindle 10 for interengaging with the corresponding ribs 32, or drive means, on the bobbin interior to transmit a rotary force from the spindle 10 to the bobbin 18. This is particularly shown on the left-hand side of FIG. 1. Should the springs 30 be initially aligned with the ribs 32 instead of the spaces between the ribs 32, the springs 30 will be pressed inwardly as indicated on the right-hand side of FIG. 1 and will spring outwardly as soon as the spindle 10 has rotated slightly relative to the bobbin 18 at the start of winding.

Referring to FIG. 1, the bobbin 18 has an internal diameter below the shoulder 20 which is larger than the external diameter of the spindle 10. Accordingly, a centering ring 34 is positioned on the spindle 10 below the center of gravity of the bobbin 18 for centering purposes.

During operation, with an empty bobbin 18 mounted on the spindle 10, a roving tail is suitably presented to the bobbin 18 and spindle 10 and clamped between the outer cylindrical surface of the bobbin 18 and the resilient lip 42. The roving tail is thus secured to the bobbin 18 for winding of a package 44 thereon. A suitable flyer for presenting the roving tail to the spindle/bobbin is described in U.S. Pat. No. 4,196,575.

Of note, U.S. Pat. No. 4,196,575 describes a manner in which a roving from a completed bobbin package on a spindle is transferred to an empty tube being donned onto the spindle. As described, after a roving has been severed between a bobbin package and a winding device, the resultant roving beard is located in the immediate vicinity of the bottom part of the bobbin tube of the package. The package is then doffed and an empty tube is donned onto the spindle while brushing the roving beard downwardly to clamp the beard between the tube and spindle. With respect to the illustrated bobbin tube of FIG. 1, the roving tail is engaged by the array of teeth 50. That is, the roving tail is passed into one of the gaps between the teeth 50 and is thereby gathered together. Next, the foot of the bobbin carries the tail into the annular member 36 which forms a resilient socket or trough. At this time, the lip 42 of the resilient ring of the annular member 36 clamps the tail against an outwardly facing surface of the bobbin 18. The tip of the roving tail is thus located within the trough defined by the annular member 36. At the same time, collection of waste material occurs within the trough.

During winding, waste material can be collected in the trough defined by the annular member 36. Thus, the bearings in the bolster 12 can be protected.

It is to be particularly noted that the lower end face 46 of the bobbin, i.e. the axially facing surface, does not contact the bottom wall 48 of the trough of the annular member 36. Thus, the portion of the bobbin 18 below the shoulder 20 is dependent from the shoulder 20 and does not provide support for the weight of the bobbin 18 or package 44. Thus, accumulated waste in the trough does not adversely affect the disposition of the bobbin 18. As shown in FIG. 2, the lower end face 46 of the bobbin 18 is provided with an array of teeth 50 which are evenly distributed around the full periphery of the bobbin 18. The roving tail passes into one of the gaps between the teeth 50 when the bobbin 18 first engages the ring 42 and the roving tail is thereby gathered together, supported and held in good condition for clamping. It is to be noted that since clamping occurs between the ring 42 and an outwardly facing surface of the bobbin 18, i.e. the surface which does not produce any substantial force component to support the bobbin 18, there is again no risk of disturbance of the disposition of the bobbin 18 due to accumulated waste on the clamping surfaces.

The bobbin 18 can be made of any suitable material such as a synthetic plastics material. Preferably, the outer wall of the bobbin 18 is made of a generally uniform section tube but formed with the ribs 32. The shoulders 20, 54 in the head portion can be provided by an additional part which is inserted into the outer wall and welded thereto.

The invention is not limited to details of the illustrated embodiment. In principle, the bobbin support surface 22 in the support structure may be on an element separate from the spindle 10 which is required to hold the bobbin upright. However, it is clearly simpler to integrate the support and alignment functions in the one element. The internal shoulder 20 which rests on the spindle 10 is not necessarily continuous around the inner periphery of the bobbin 18. This shoulder could, for example, be provided by an array of sub-shoulders formed on the individual ribs 32, which can extend further upwards into the chamber 52. The position of the shoulder 20 along the length of the bobbin 18 can be varied, but preferably is such as to enable use of the upper end of the spindle 10 for the bobbin supporting surface. The annular member 36 for the lip 42 is not necessarily formed as a trough, but preferably has an undersurface forming a labyrinth seal 58 (FIG. 1) to protect the bolster bearings.

FIG. 2 illustrates the preferred form of the teeth 50, although this form is also not essential. As shown, the teeth 50 have flanks disposed at an angle $\alpha$, preferably about 60 degrees although 50 to 70 degrees is acceptable. Each tooth 50 is short—about 3 millimeters (mm) is preferred, but 2 to 5 millimeters (mm) is acceptable. The spacing of the teeth 50 at the lower edge of the bobbin may be about 5 millimeters (mm), although 4 to 7 millimeters (mm) is acceptable. Finally, the outside of each tooth 50 is preferably chamfered, as indicated at B in FIG. 2, to facilitate insertion into the resilient lip 42. A chamfer angle B of about 6 degrees is preferred although 4 to 8 degrees is acceptable.

The overall dimensions of the bobbin 18 will depend upon the size of package to be produced, the dimensions of the roving machine, the construction of the automatic doffer and a variety of other factors. An important feature is the selection of the length of the depending portion of the bobbin, i.e. the distance between the shoulder 20 and the end surface 46 of the teeth 50, so that this portion will hang from the endcap 24 and not rest on the base of the annular member 36.

What is claimed is:

1. A bobbin support structure for a roving frame comprising a spindle;

bobbin engaging means on said spindle for engaging an internal shoulder of a tubular bobbin to support the bobbin;

drive means on said spindle for inter-engaging with a corresponding drive means on the bobbin interior to transmit a rotary drive force from said spindle to the bobbin; and means on said spindle and rotatable therewith for clamping a roving tail against an outwardly facing surface of a lower end of a received bobbin.

2. A bobbin support structure as set forth in claim 1 wherein said means for clamping is an annular member forming a resilient socket located on said spindle to receive said lower end of a received bobbin supported by said bobbin engaging means.

3. A bobbin structure as set forth in claim 1 wherein said means for clamping is formed separately from said spindle and is secured to said spindle for rotation therewith.

4. A bobbin support structure as set forth in claim 1 wherein said means for clamping includes a trough for receiving fibers separated from a roving tail.

5. A bobbin support structure as claimed in claim 4 further comprising a spindle bolster and a bearing mounted in an opening in said bolster for rotatably mounting said spindle therein, said trough being disposed above said opening with said spindle rotatably mounted in said bearing.

6. A bobbin support structure as claimed in claim 5 wherein the side of said trough facing said bolster and the facing surface of said bolster are provided with interengaging portions forming a seal around said opening.

7. A bobbin support structure as claimed in claim 4 wherein said trough comprises an upstanding portion encircling said spindle engaging inside the interior of the lower end of the received bobbin.

8. A bobbin support structure as set forth in claim 1 wherein said means is an annular member secured to said spindle and having an inwardly projecting resilient lip to engage a bobbin mounted on said spindle.

9. A bobbin support structure as set forth in claim 8 wherein said lip is an annular lip.

10. In combination, a spindle having an end surface at one end;

a bobbin having a tubular body with an internal shoulder seated on said one end surface of said spindle and a depending portion depending from said shoulder;

drive means on said spindle inter-engaging with corresponding drive means on an interior of said bobbin to transmit a rotary drive force from said spindle to said bobbin; and means on said spindle and rotatable therewith for clamping a roving tail against an outwardly directed surface at an end of said depending portion.

11. The combination as set forth in claim 10 wherein said spindle has a pair of outwardly biased springs thereon and said bobbin has a plurality of inwardly directed ribs adjacent to said shoulder in interfitting relation with said springs.

12. The combination as set forth in claim 10 wherein said spindle is vertically disposed and said bobbin has a head portion above said shoulder with means thereon for engaging with a doffer element.

13. The combination as set forth in claim 10 wherein said means is an annular member forming a trough receiving said depending bobbin end and includes a resilient ring encircling and engaging said bobbin.

14. The combination as set forth in claim 10 wherein said bobbin has circumferential array of teeth at said depending bobbin end for gathering an end of a roving tail clamped between said end and said clamping means.

15. The combination as set forth in claim 14 wherein each tooth has flanks disposed at an angle of from 50 degrees to 70 degrees.

16. The combination as set forth in claim 10 wherein said end surface is frusto-conical and said shoulder is conical.

17. The combination as set forth in claim 16 wherein said means is an annular member secured to said spindle to define a trough and having an inwardly projecting resilient lip engaging said bobbin to clamp a roving therebetween.

18. The combination as set forth in claim 17 wherein said lip is an annular lip.

19. In an roving frame, a bobbin support structure having a spindle; bobbin engaging means on said spindle for engaging an internal shoulder of a tubular bobbin to support the bobbin; drive means on said spindle for inter-engaging with a corresponding drive means on the bobbin interior to transmit a rotary drive force from said spindle to the bobbin; and means on said spindle and rotatable therewith for clamping a roving tail against an outwardly facing surface of a received bobbin adjacent one end of the bobbin.

20. In combination, a spindle having an end surface at one end;

a bobbin having a tubular body with an internal shoulder seated on said one end surface of said spindle and a depending portion depending from said shoulder;

drive means on said spindle inter-engaging with corresponding drive means on an interior of said bobbin to transmit a rotary drive force from said spindle to said bobbin; and, an annular member forming a trough receiving an end of said depending bobbin portion and including a resilient ring encircling and engaging said bobbin for clamping a roving tail against an outwardly directed surface at said end.

* * * * *